US005566901A

United States Patent [19]

Wilder

[11] Patent Number: 5,566,901

[45] Date of Patent: Oct. 22, 1996

[54] METHOD AND APPARATUS FOR WINDING FIRE HOSE

[76] Inventor: Ray J. Wilder, 23 Transylvania St., Piedmont, S.C. 29676

[21] Appl. No.: 354,510

[22] Filed: Dec. 13, 1994

[51] Int. Cl.[6] ..... B65H 75/34

[52] U.S. Cl. ..... 242/532.6; 242/395; 242/397

[58] Field of Search ..... 242/395, 397, 242/397.1, 397.2, 397.3, 397.4, 397.5, 398, 402, 405.3, 532.6; 137/355.26, 355.27

[56] References Cited

U.S. PATENT DOCUMENTS

| | | | |
|---|---|---|---|
| 1,089,265 | 3/1914 | Ridley . | |
| 1,915,632 | 6/1933 | Marks | 242/395 |
| 2,396,451 | 3/1946 | Warkentin | 242/532.6 |
| 3,124,321 | 3/1964 | Rylott et al. . | |
| 4,057,198 | 11/1977 | Whitfield . | |
| 4,198,010 | 4/1980 | Knapp . | |
| 4,475,698 | 10/1984 | Militello . | |

FOREIGN PATENT DOCUMENTS

| | | | |
|---|---|---|---|
| 0600770A1 | 6/1994 | European Pat. Off. | 242/397 |

*Primary Examiner*—John P. Darling
*Attorney, Agent, or Firm*—Leatherwood Walker Todd & Mann, P.C.

[57] ABSTRACT

A hose winding method and device for use in connection with collapsible hose, such as fire hose. A self-supporting, stand-alone support structure is provided with an elongated crankshaft extending the width thereof. One end of the crankshaft includes a yoke for receipt of a hose couple, and the other end of the crankshaft includes a handle for turning the yoke such that the hose is wound about the yoke. A hose guide is provided upstream of the yoke and includes a stationary hose engagement portion which frictionally engages the hose to force water out of the hose and also to flatten the hose. The hose winder configuration allows for hoses to be wound at a variety of locations and on a variety of terrains.

9 Claims, 3 Drawing Sheets

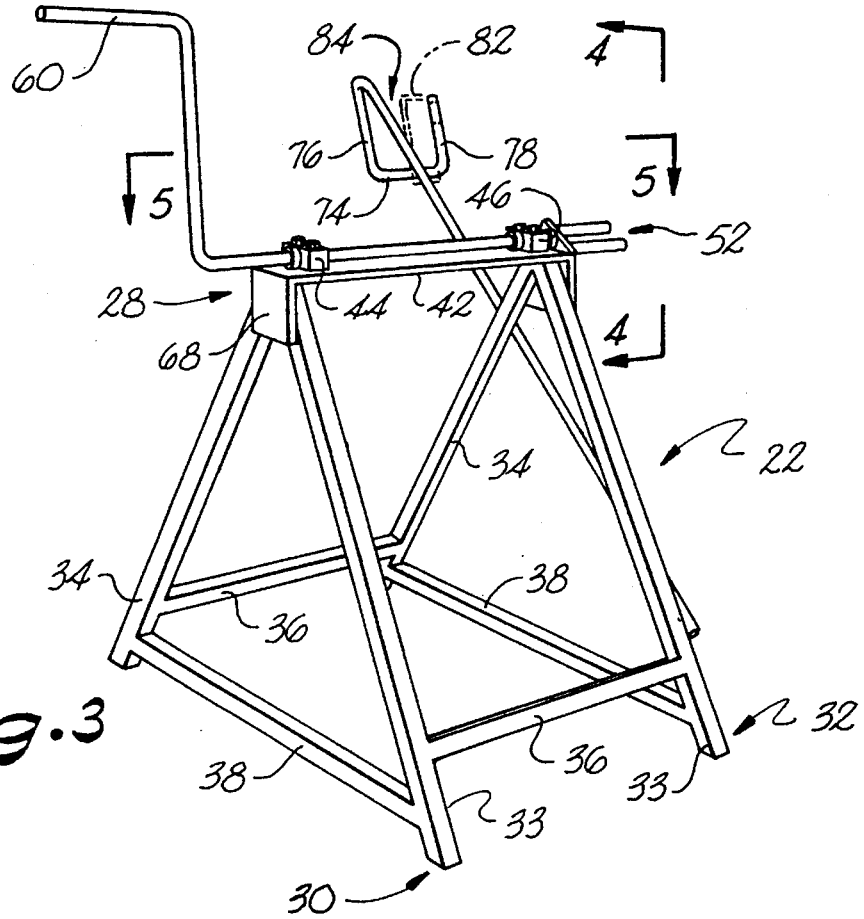
Fig. 3
Fig. 4
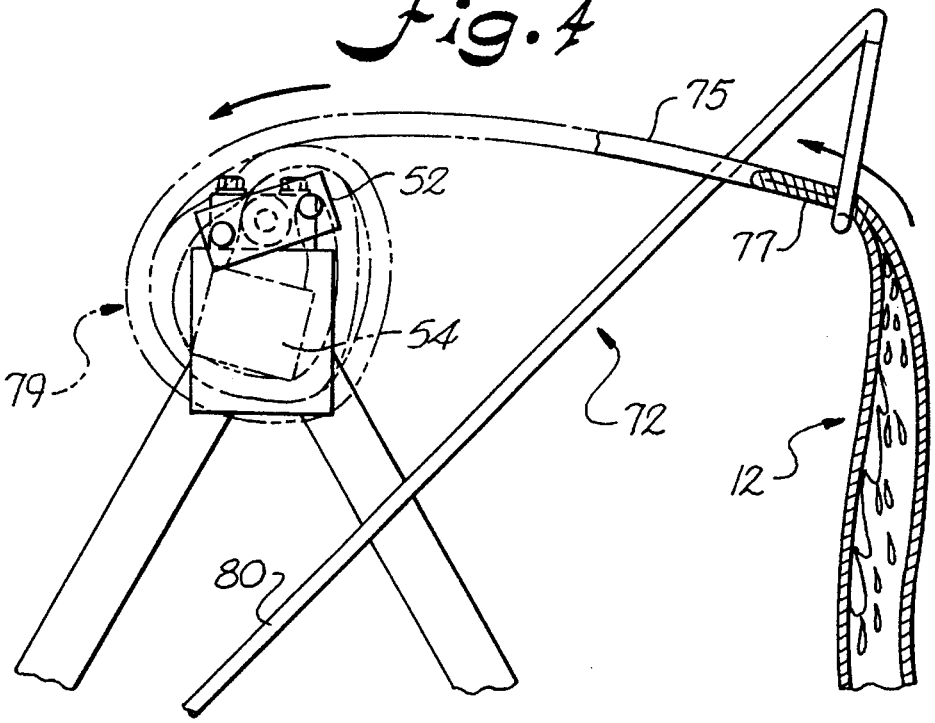

METHOD AND APPARATUS FOR WINDING FIRE HOSE

BACKGROUND OF THE INVENTION

This invention relates generally to an extremely portable fire hose winding machine for use in on-site winding and draining of fire hoses prior to transport and/or storage.

In fighting fires, firetrucks generally transport fire hose to and from the scene of the fire. The fire hoses are removed from the truck at the scene and are connected to a water supply. Fire hose typically comes in sections, with each section having a coupling at each end for allowing a number of sections to be joined together to form a combined hose length from several hundred to several thousand feet. The couplings also allow for the fire hose to be connected to a water supply at one end and a spray nozzle at the other end.

After the fire has been extinguished or otherwise brought under control, the fire hose is disconnected from the water supply, and each section is disconnected from adjacent sections. Each section must then be drained of water and wound into a roll for transport back to the fire station, where each section will be washed and dried for later use. Usually these winding operations are presently performed by fire fighters manually winding the hose into a spiral roll, which is done after first draining water from the section and arranging the hose in a generally straight line. This is a labor-intensive procedure which fire fighters generally would not look forward to after an exhausting battle with a fire.

Various hose winding devices have been patented. For example, U.S. Pat. No. 4,265,414, issued to Spradling, discloses a fire hose winding device having a crank connected to a disc member with tines for receiving a hose coupling. A rotatable spool is spaced from the disc member and supports the hose during winding. The device is designed for mounting to another object, such as a fire engine.

U.S. Pat. No. 4,475,698, issued to Militello, discloses a hose winding device carried by the user having a crank which drives a chain to turn a coil mechanism.

U.S. Pat. No. 4,057,198, issued to Whitfield, discloses a hose winding device mounted on rollers having a handcrank for rotating a pair of tine members, which receive a hose coupling. Rollers are provided for guiding the hose being wound. U.S. Pat. No. 4,592,519, issued to Peacock, discloses a hose rolling device which is apparently designed for mounting on an object and which includes a hand-operated winding mechanism.

U.S. Pat. No. 5,033,690, issued to McIver, discloses a hose rolling device having a hand-operated crank and guide means for guiding the hose. The device is configured for mounting to a stationary object, which may include a tree, post, etc.

U.S. Pat. Nos. 3,124,321, issued to Rylott, et al., and 4,198,010, issued to Knapp, both disclose motorized fire hose winding devices.

U.S. Pat. No. 1,089,265, issued to Ridley, discloses a fire hose wheel having a manually operated gear-driven winding mechanism. U.S. Pat. No. 4,311,288, issued to Galland, discloses a winding device for use with truck load straps.

While the foregoing designs are known, there still exists a need for stand-alone fire hose winding machine which is of relatively simple and efficient operation and construction and which is highly portable.

A particularly useful device would be a lightweight, portable fire hose winder which could be operated manually, thereby increasing its versatility by not requiring an external power source, such an electric or gasoline motor. Such a hose winder would ideally be readily useable in virtually any location and would be free-standing, thereby eliminating the need for its attachment to some other item, such as a truck, vehicle bumper, post, tree, or the like. Further, a desirable portable hose winder would be readily useable on smooth or rough terrain and would be easily transported by hand carrying.

SUMMARY OF THE INVENTION

It is, therefore, the principal object of this invention to provide a method and apparatus for efficiently winding a hose.

It is another object of the present invention to provide a stand-alone, self-supporting fire hose winding machine.

It is another object of the present invention to provide a portable fire hose winding device useable on a variety of surfaces and terrains.

It is still another object of the present invention to provide a hose winding device which drains fluid from the hose as the hose is being wound.

It is still a further object of the present invention to provide a hose winding device which effectively collapses the hose as it is being wound.

It is still another object of the present invention to provide a hose winding device which may be easily carried in a pickup truck, automobile, boat, airplane, or the like.

It is still a further object of the present invention to provide a manually-operated hose winding device which is of relatively simple and lightweight construction.

It is yet another object of the present invention to provide a hose winding device for winding hoses of different diameters.

Generally, the present invention includes a self-supporting winding device for winding a fluid-carrying hose and comprises a free-standing support structure having first and second spaced apart side portions extending substantially the height of the support structure. The support structure has a longitudinally extending upper portion and a base portion, the upper portion extending substantially from the first side to the second side, and the base portion being contactable with a surface for supporting the support structure.

A crankshaft is provided having first and second ends, the crankshaft extending substantially the length of the upper portion of the support structure. A bearing member is rotatably connected to the crankshaft and the upper portion of the support structure. A handle is connected to the crankshaft for allowing a user to rotate the crankshaft, and a coupling holder is connected to the other end of the crankshaft for rotation with the crankshaft. The coupling holder is adapted for receipt of an end of the hose and for winding the hose thereon as the crankshaft is rotated.

A hose guide is connected to the support structure and extends outwardly therefrom for guiding the hose as the hose is wound about the coupling holder. The hose guide has spaced apart upstanding portions and a substantially horizontally extending static hose engaging member for frictionally engaging the underside of the hose during winding, for simultaneously flattening the hose and forcing fluid from the hose as the hose passes over the hose engaging member.

A method of winding a hose is also encompassed by the present invention and involves use of a hose winding device generally as set forth herein.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 3 is another perspective view of a hose winding device constructed in accordance with the present invention;

FIG. 4 is a sectional view taken along lines 4—4 of FIG. 3;

DESCRIPTION OF THE PREFERRED EMBODIMENT

Figure 1:
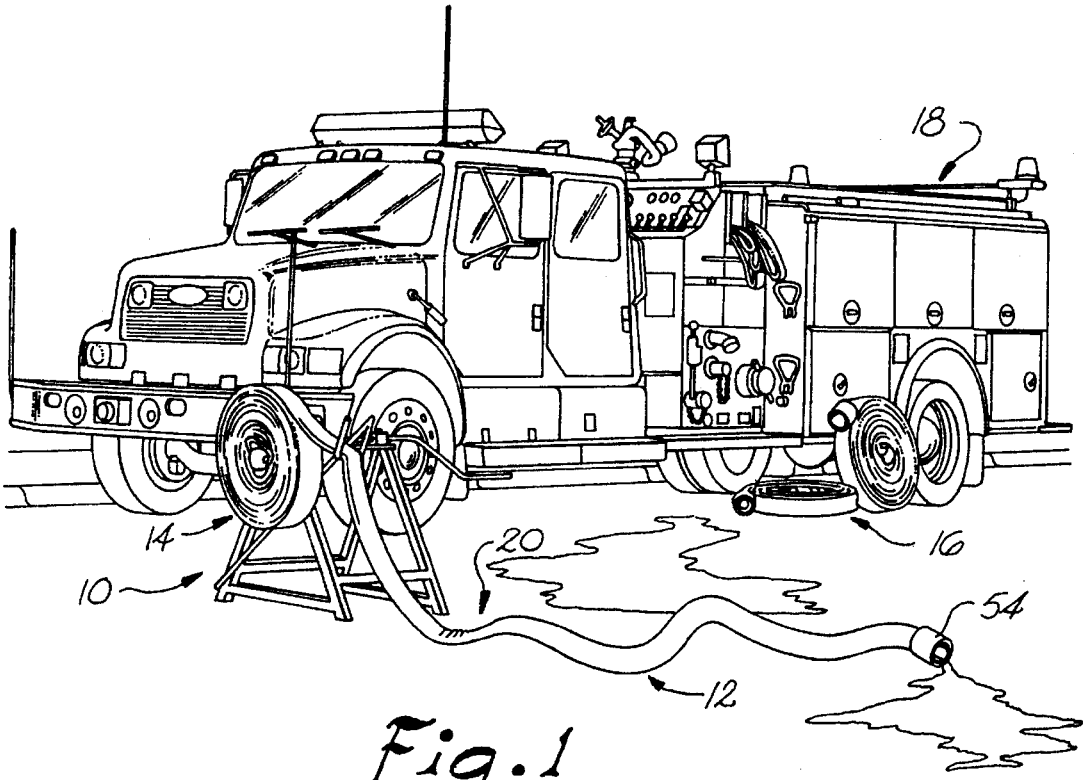
FIG. 1 is a perspective view of a hose winding device constructed in accordance with the present invention in a typical operating environment.

The accompanying drawings and the description which follows set forth this invention in its preferred embodiment. However, it contemplated that persons generally familiar with hose winding devices will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the fire hose winding machine of the present invention is indicated generally in the figures by reference character 10.

Turning first to FIG. 1, hose winding device 10 is illustrated in its operational configuration on site at the scene of a fire or exercise. A fire hose, generally 12, is shown having already been partially wound into a roll, generally 14. Hose sections, generally 16, which have already been drained, flattened, and wound by hose winder 10 are also illustrated in FIG. 1 adjacent to a fire truck, generally 18. As can be seen from the figures, hose winder 10 is a stand-alone mechanism which is simply placed on the ground or street, generally 20, when being used, or on some other surface.

Figure 2:
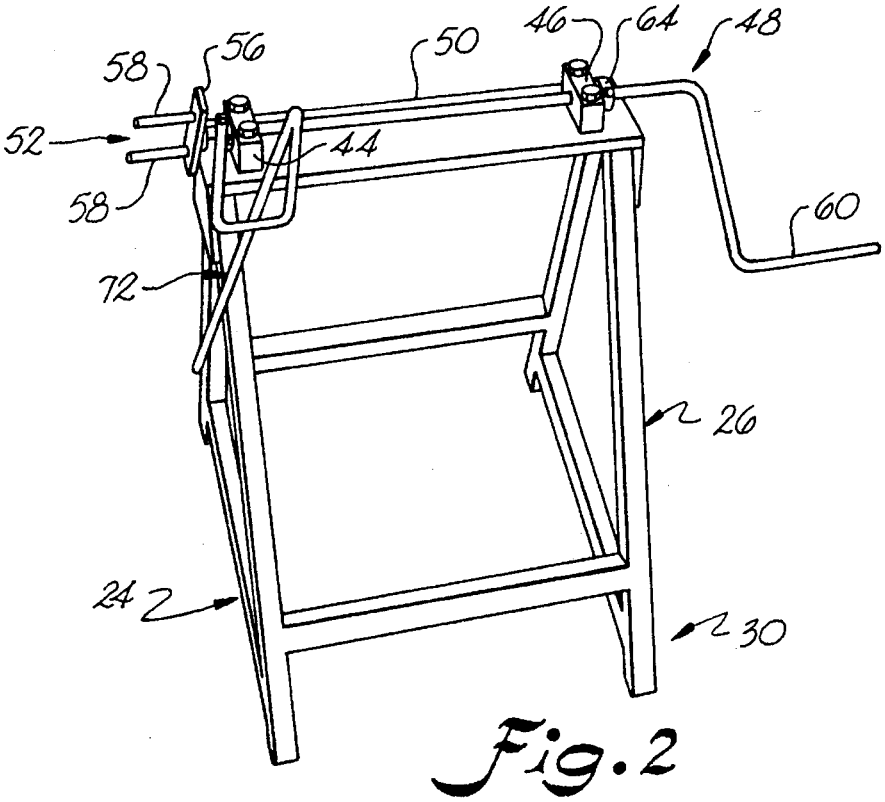
FIG. 2 is a perspective view of a hose winding device constructed in accordance with the present invention.

Turning to FIGS. 2 and 3, hose winder 10 is illustrated in more detail. Hose winder 10 includes a support structure, generally 22, having first and second spaced apart side portions, 24 and 26, respectively, a longitudinally extending upper portion, generally 28, and a base portion, generally 30, having four feet 32 for resting on the ground, pavement, or some other surface. While hose winder 10 is illustrated as having four legs, including two front legs, generally 33, and two rear legs, generally 34, and one foot member 32 corresponding to each of legs, it is to be understood that hose winder 10 could include more or less than four legs 34 and four feet 32. For example, hose winder 10 could be of a tripod-type construction (not shown) having only three legs and feet. Each leg includes a first longitudinally extending cross-brace member 36 extending the width of hose winder 10 and a second longitudinally extending cross-brace member 38 extending the length of hose winder 10.

Hose winder 10 is preferably constructed of tubular steel, and cross-braces 36, 38 are preferably welded to respective legs 33, 34. However, it is to be understood that angle-iron channel members, solid bar stock, and the like, could also be used to construct hose winder 10 as well as materials other than steel. For example, hose winder 10 could be constructed of aluminum, or iron, or some other suitable material, such as high-strength plastic, fiberglass, etc.

Figure 6:
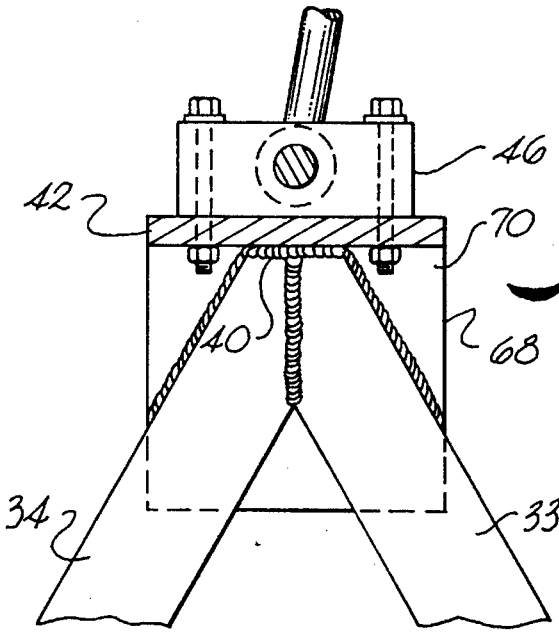
FIG. 6 a sectional view taken along lines 6—6 of FIG. 5.

Support structure, or frame, 22 is of a generally A-frame construction, as shown in FIG. 6, and includes at the top apex 40 thereof a crankshaft mounting member 42 which extends the width of frame 22. Crankshaft mounting member 42 is fixedly attached to the upper portion of frame 22 and includes bearing devices 44, 46 provided near each end of mounting member 42. Bearing members 44, 46 could be any of a variety of configurations and could include pillow block bearings, drilled bearings with grease fittings, or the like, and serve to rotatably support a crankshaft, generally 48, relative to frame 22.

Figure 5:
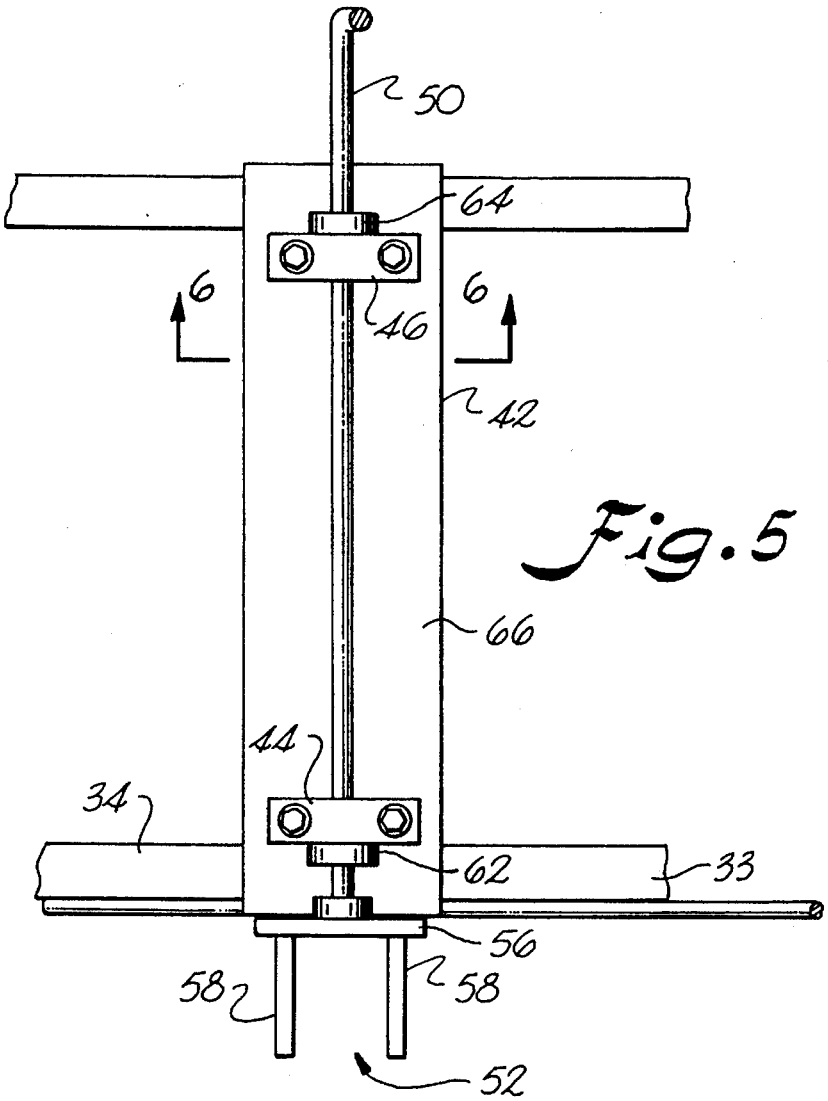
FIG. 5 is a sectional view taken along lines 5—5 of FIG. 3.

Crankshaft 48 includes an elongated axle portion 50 which extends the full width of frame 22 and preferably extends outwardly beyond the two sides 24, 26 of frame 22. Fixedly attached to one end of axle 50 is a coupling holder, or yoke, 52 for receipt of a coupling 54 of a fire hose. Yoke 52 includes a first member 56 extending substantially perpendicularly to the end of axle 50 and to upstanding members 58 which extend substantially perpendicularly to member 56, and substantially parallel to axle 50. The other end of crankshaft 48 includes a handle portion 60 which is to be grasped by the user during the operation of hose winder 10 for winding hose 12 about yoke 52. Collars 62, 64, as shown in FIG. 5, may also be provided on axle 50 to restrain crankshaft 48 from longitudinal movement with respect to bearings 44, 46.

While crankshaft support member 42 is illustrated as having a relatively horizontal planar portion 66 and two downwardly extending flanges 68, 70, crankshaft support member 42 could be constructed in a variety of other configurations to provide support for the crankshaft, or could be eliminated altogether by an embodiment not shown, wherein axle 50 simply extends through the upper portion 28 of the frame, with bearing devices being attached to the legs directly.

Extending outwardly in front of frame structure 22 is a hose guide, generally 72. Hose guide 72 is positioned upstream of yoke 52, in relation to the hose travel direction during winding, and includes a horizontally extending hose engaging portion 74 and adjacent upright portions, 76, 78. Hose guide 72 is supported by an angled support member 80, which is fixedly attached to the legs of first side 24 of frame 22. Hose engaging portion 74 is preferably stationary instead of having a rotatable roller or wheel provided thereon.

The static aspect of hose engagement member 74 serves to increase frictional engagement of member 74 with the hose as the hose passes over member 74 when being wound. This increased frictional engagement on the underside of the hose is particularly important since the tension in the upper side 75 of the hose would generally be greater than in the underside 77 of the hose, because the outer side forms a larger peripheral surface upon being wound on a roll 14 on the yoke than would the underside surface. This tension differential between the upper side of the hose and the underside of the hose forces the lower portion of the hose more closely together with the upper side of the hose to form a squeegeeing type of effect illustrated in FIG. 4 for extracting water from the hose during winding.

Hose winder 10 is designed to be portable and to be carried on a fire truck, in a fire fighter's car, in a pickup truck, etc., and may be placed at a variety of locations at the fire scene for winding hoses. This allows greater flexibility in the location where hose winding is to be performed than would be the case if the hose winder was fixedly attached to the fire truck or some other object. By allowing hose winding at a relatively remote location from the truck, emergency personnel, traffic, etc. may be allowed freer access to and around the truck than would be case if the hose winder was fixedly attached to the truck. Further, because of the compact design, a volunteer fireman, for example, could keep the hose winder in his truck or car, or easily place the hose winder in the car when called to respond to a fire.

Because of its configuration, hose winder 10 is stable enough to carry a fully wound hose on one end without tipping over. This eliminates the need for fixing the hose winder to some other stationary device. Further, by placing the crank handle on the other side of the frame, the user may be able to gain better access to the handle when turning the crankshaft than possibly would be the case with a hose winder fixedly attached to a separate structure.

As illustrated in phantom in FIG. 3, a hose guide adapter 82 could be inserted on an upright 78 of hose guide 72 to narrow the effective width of the hose guide passage 84 defined between uprights 76, 78, thereby allowing hose guide 72 to be used on narrower hose, if desired. While the present invention has been discussed in relation to fire hose, it is to be understood that it can also be used for winding other types of hoses, and in particular collapsible hoses, such as irrigation hoses, drainage hoses, etc.

Hose guide 72 performs several functions during winding of a hose. First, hose guide 72 guides the hose as it is wound about yoke 52 such that a coherent, concentric roll of hose is formed. Hose guide 72 also, because of its elevation in relation to frame 22, causes the hose to be lifted during winding which, in turn, facilitates drainage of water out of the hose by gravity. The tension provided in the hose as it is being wound by the turning the yoke and by frictional engagement with the hose guide causes the hose to collapse as it passes through the hose guide. Additionally, as discussed above, the frictional engagement of the hose with static hose engaging member 74 simultaneously causes a squeegeeing effect in the hose to force water out as the hose is wound.

In one particular embodiment which has been found to operate desirably, at base portion 30, the length of frame 22, i.e., the distance between first and second sides 24, 26 of frame 22 is approximately 16 inches, and the width of frame 22, i.e., the distance between feet 33 and 34 is approximately 26 inches. Legs 33, 34 are approximately 24 inches in length, and frame 22 is approximately 20 inches tall. This particular configuration has been found in operation to be readily manageable and transportable and also sturdy enough to allow vigorous winding of a hose thereon while not tipping over once a full roll of hose has been wound.

In operation, a coupling end of the hose is guided through hose guide 72 and placed between uprights 76, 78 of yoke 52. Handle 60 of crankshaft 48 is then turned, which causes the hose to advance through the hose guide, being flattened and drained in so doing, and causing the hose to be wound in a roll of ever increasing diameter about yoke 52. Once the full length of the hose has been wound into a roll, the roll is simply pulled directly off of the yoke, along with coupling 52 of the hose.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A self-supporting hose winding device for winding a fluid-carrying hose, the winding device being for placement on a support surface, the winding device comprising:

a free-standing support structure having first and second spaced apart side portions, said support structure having a base for contacting the support surface, said base portion having a length dimension at least half of the width dimension of said base portion;

a crankshaft extending substantially the length of said support structure and rotatably connected to said support structure, said crankshaft having first and second ends;

a handle connected to said first end of said crankshaft for allowing a user to rotate said crankshaft;

a hose end holder connected to said second end of said crankshaft for rotation therewith, said hose end holder extending outwardly from said second side portion and being adapted for receipt of an end of the hose and for winding the hose thereon as said crankshaft is rotated; and a hose guide member connected to said support structure and extending outwardly therefrom for guiding the hose as the hose is wound about said hose end holder, said hose guide member having spaced apart upstanding portions defining a hose passage therebetween and a substantially horizontally extending stationary hose-engaging member for frictionally engaging the underside of the hose during winding to simultaneously flatten the hose and force fluid from the hose as the hose passes over said hose-engaging member.

2. A self-supporting hose winding device as defined in claim 1, wherein the width dimension of said base portion is approximately one and one-half times the length dimension of said base portion.

3. A self-supporting hose winding device as defined in claim 1, wherein the width of said support structure is between 1.25 and 1.5 times the width of said base portion.

4. A self-supporting hose winding device for winding a fluid-carrying hose, the winding device being for placement on a support surface, the winding device comprising:

a free-standing support structure having first and second spaced apart side portions, said support structure having a longitudinally extending upper portion and a base portion, said upper portion extending substantially from said first side to said second side, said base portion being contactable with the support surface for supporting said support structure;

a crankshaft having first and second ends, said crank shaft extending substantially the length of said upper portion of said support structure;

at least one bearing member connected to said support structure and rotatably connecting said crankshaft to said support structure;

a handle connected to said first end of said crankshaft for allowing a user to rotate said crankshaft and said second end of said crankshaft extending outwardly from said second side portion;

a hose end holder connected to said second end of said crankshaft for rotation therewith and extending outwardly from said second side portion, said hose end holder being adapted for receipt of an end of the hose and for winding the hose thereon as said crankshaft is rotated; and a hose guide connected to said support structure and extending outwardly therefrom for guiding the hose as the hose is wound about said hose end holder, said hose guide having spaced apart upstanding portions defining a hose passage therebetween and a substantially horizontally extending stationary hose-engaging member for frictionally engaging the underside of the hose during winding to simultaneously flatten the hose and force fluid from the hose as the hose passes over said hose-engaging member.

5. A self-supporting hose winding device as defined in claim 4, further comprising a hose guide adapter connected to said hose guide for varying the width of said hose passage.

6. A self-supporting hose winding device as defined in claim 4, wherein said stationary hose-engaging member of said hose guide is at an elevation at least as high as that of said hose end holder.

7. A self-supporting hose winding device as defined in claim 4, wherein said hose guide is connected to and extends outwardly from said second side portion.

8. A self-supporting hose winding device as defined in claim 4, wherein said support structure defines a front portion and a rear portion each being of substantially the same width with respect to one another, and wherein, at said base portion, the width of each of said front and rear portions is approximately two thirds the width of each of said first and second side portions.

9. A self-supporting hose winding device as defined in claim 4, wherein the height of said support structure is less than the width of said first side portion at said base portion.

* * * * *